United States Patent [19]

Lennon

[11] Patent Number: 4,878,547

[45] Date of Patent: Nov. 7, 1989

[54] ROCK DRILLING APPARATUS

[75] Inventor: Archie A. Lennon, Troutville, Va.

[73] Assignee: Ingersoll-Rand Company, Woodcliff Lake, N.J.

[21] Appl. No.: 368,904

[22] Filed: Jun. 21, 1989

Related U.S. Application Data

[63] Continuation of Ser. No. 264,016, Oct. 28, 1988, abandoned.

[51] Int. Cl.[4] ..... E21B 04/16

[52] U.S. Cl. ..... 175/53; 175/96; 175/203

[58] Field of Search ..... 175/53, 62, 88, 96, 175/102, 203, 417, 415

[56] References Cited

U.S. PATENT DOCUMENTS

| | | | |
|---|---|---|---|
| 4,043,136 | 8/1977 | Cherrington | 175/53 |
| 4,410,053 | 10/1983 | Masse | 175/53 |
| 4,627,501 | 12/1986 | Ebeling | 175/325 |
| 4,729,439 | 3/1988 | Kurt | 175/96 |

FOREIGN PATENT DOCUMENTS

| | | | |
|---|---|---|---|
| 1024503 | 1/1978 | Canada | 175/53 |

*Primary Examiner*—Jerome W. Massie, IV
*Assistant Examiner*—Terry Lee Melius
*Attorney, Agent, or Firm*—James R. Bell

[57] ABSTRACT

A rock drilling apparatus wherein the rock drill is a cluster of independent rock drills arranged in a circular pattern about a central axis for rotation. The cluster drill is drawn into a hole to be drilled by a drill string in a previously drilled smaller diameter hole. The drill string provides pressure fluid to operate the cluster drill and rotation as well as the tractive force to draw the cluster drill into the hole to form a large diameter straight drilled hole. Pressure fluid and rock cuttings exit the larger diameter hole and discharge of rock particles is further aided by use of a trailing auger rotated by the cluster drill. A particular application of this device is in the production of horizontal bored holes of moderate diameter under, for example, roadways, foundations, and the like. The drill string acting as a centering device produces a straight hole in difficult rock formations.

11 Claims, 2 Drawing Sheets

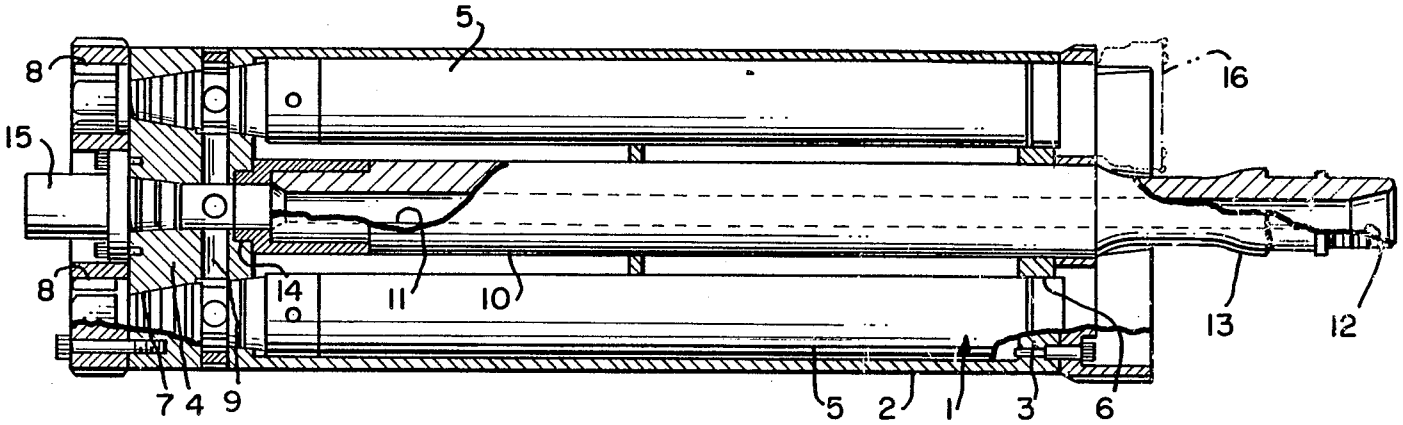
FIG. 1
FIG. 2
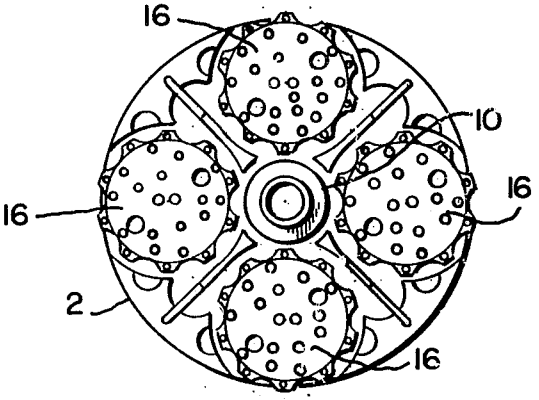

ROCK DRILLING APPARATUS

This application is a file wrappre continuation of application Ser. No. 264,016, filed Oct. 28, 1988, now abandoned.

BACKGROUND OF THE INVENTION

During construction it is often desirable to drill horizontal holes in rock under roadways and building foundations without disturbing those structures. Such horizontal holes may be used for utility services, or drainage, or the like, and for this purpose it is desirable to have a straight hole economically drilled with a minimum of ground disturbance.

To accomplish such holes it is common to dig a shaft on either side of the structure and by means of auger in soft ground, or a rock drill in harder ground, drive the hole from shaft to shaft. This is accomplished by utilizing conventional drilling techniques which push the auger or rock drill utilizing a rotary drill string. The auger or drill and trailing drill string is inserted in sections and driven from one of the shafts to the other.

Core drills have been developed for small diameter holes which are relatively effective in drilling accurate straight holes between two locations. However, effective core drilling is limited to holes of about 4 to 8 inches or smaller because the cores must be drilled in segments, usually a maximum of twenty (20) ft. and removed.

In larger size holes the process would be slow and the cores become increasingly difficult to remove, particularly in hard rock. As a result, a common practice has developed in boring larger diameter holes to first bore a cored hole and thereafter force a series of rotary ring reamers through the hole to increase the hole size to the diameter desired.

Reaming is also time-consuming and in general produces a hole which is rough and/or cork screwed and as the size increases it becomes more difficult to maintain the progress without buckling the drill string creating the rotary drive and force on the ring cutters. An improvement to this method involves the pulling of the ring cutters back through the hole but since this is a progressive stepwise operation the difficulty of the reamer walking about the hole diameter, although improved, is still limited as set forth above. Thus, it is apparent that it would be advantageous to provide an alternative directed to overcoming one or more of the foregoing limitations.

SUMMARY OF THE INVENTION

In the present invention a horizontal hole is accomplished by first sinking a shaft on either side of the hole to permit access. Next, a small diameter hole between the shafts of approximately 4" is bored by core drilling. A drill string is next inserted in the hole. A modified clustered drill, generally of the type shown and described in U.S. Pat. No. 4,729,439, entitled "Gang Drill Construction" and assigned to Ingersoll-Rand Company, the assignee of the present invention, is attached to the drill string. For purposes of this invention the center drill is removed and replaced by a section of drill rod or center feed rod which supplies the gang drill with pressure fluid from its opposite end, that is the end that normally contains the rock cutting bits. This permits the cluster drill to be reverse mounted to the drill string inserted in the cored drill holee. The gang drill is then supplied with pressure fluid to operate the circumferentially mounted impact rock drills. The drill string is then rotated and withdrawn through the hole tailing and rotating the cluster drill. Pressure fluid and rock drill cuttings exit the large diameter hole in the conventional manner. As an added feature, sections of auger may be attached to the back of the gang drill to effect additional cleaning of the horizontal hole as the gang drill is drawn through the hole and rotated. This will reduce the overall air requirements necessary for cleaning the hole.

It is therefore an object of the present invention to provide apparatus for the drilling of accurate large diameter horizontal holes in hard rock. It is an object of the invention to drill such holes in hard rock at high speed with efficiency and minimum air consumption. It is yet a further object to accomplish the drilling of large diameter horizontal holes in hard rock by utilizing easily modified and available cluster drills, and simple rugged and reliable boring equipment of a small size compared to similar methods for similar size holes in hard rock.

BRIEF DESCRIPTION OF THE DRAWINGS

FIG. 1 shows a cross section view of a cluster drill modified according to the present invention for forward pressure fluid supply and rotation.

FIG. 2 is an end view of the cluster drill.

DESCRIPTION OF THE PREFERRED EMBODIMENT

Figure 3:
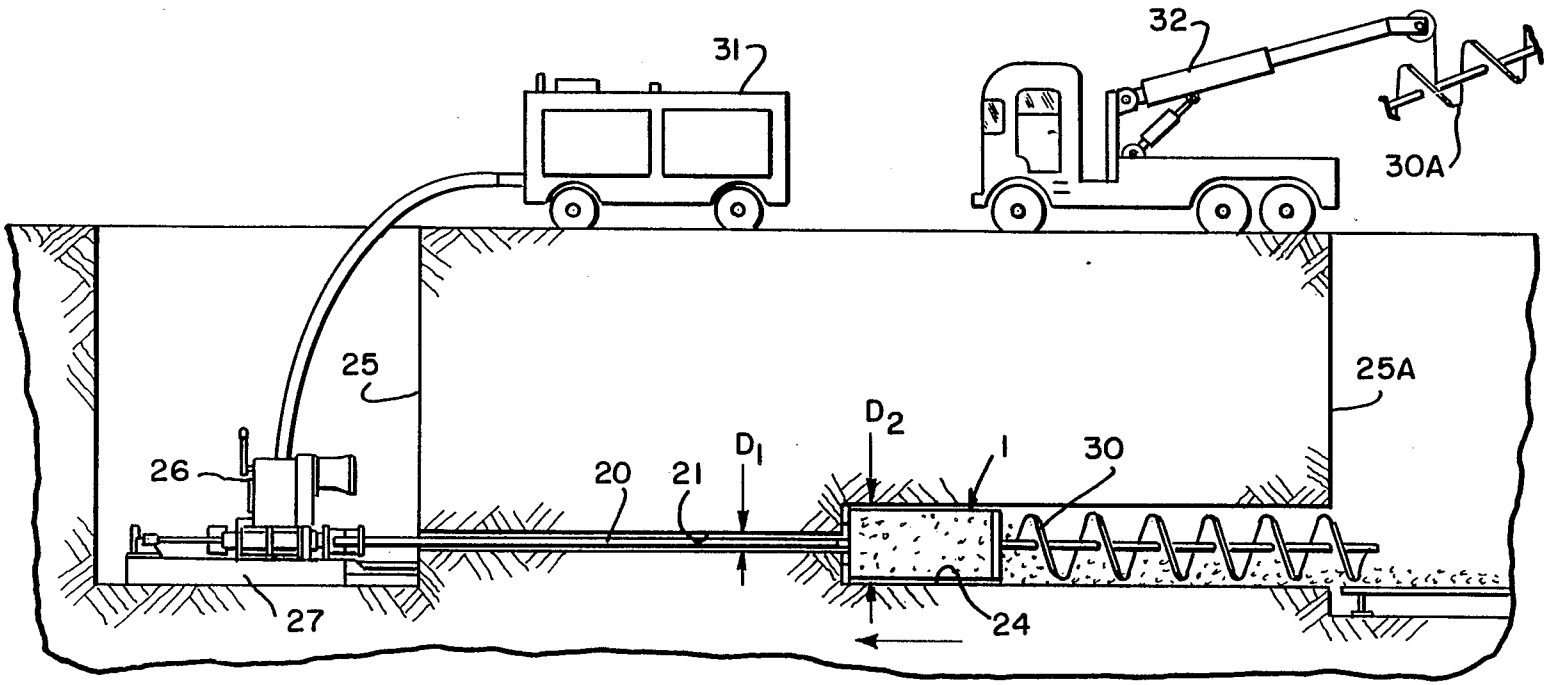
FIG. 3 shows a pictorial representation of the horizontal reverse drilling system according to the present invention.

Referring now to FIG. 1 a cross section of the modified cluster drill is shown and generally designated by Reference Numeral 1. The drill is comprised of a cylindrical body barrel 2 having an end plug 3 at its forward or work producing end and a back head 4 at its rearward end. A plurality of downhole drills 5 are mounted in the barrel body 2 in a manner previously disclosed in U.S. Patent No. 4,729,439 which is incorporated herein by reference for description of cluster drills of this general type.

In general, each of the individual drills 5 are mounted in a bore 6 in the plug 3 and a tapered bore 7 in the back head 4. The tapered bore 7 cooperates with a taper 8 on each of the individual downhole drills 5. Each of the downhole drills 5 are retained in their respective tapered bores 7 by means of a cap nut 8. Pressure fluid is distributed to each of the circumferentially mounted downhole drills 5 by means of radial distribution bores 9.

In the prior art cluster drill the drill string is attached to the back head and supplies pressure fluid to the radial distribution bores. In the present invention the center drill is removed and replaced with a core rod 10. The core rod 10 is provided with a central bore 11 which now supplies pressure fluid to the back head. The core rod 10 is provided with a thread 12 at its forward end 13 and is connected to the back head by a thread 14 or or other convenient means.

Attached also to the back head is a socket flange 15 which permits attachment of an auger to the back head end of the drill. Mounted to each of the downhole drills 5, is a rock drill bit 16 (shown in phantom) which is impacted upon by the downhole drill and thereby fragment and remove rock particles. FIG. 2 shows the orientation of the downhole drills 5 about the central axis provided by the core rod 10. It should be appreciated by one skilled in the art that pressure fluid (commonly compressed air) may be supplied via the core rod 10 through the radial distribution bores 9 in the back head 4 to each of the individual downhole drills 5. The pressure fluid creates a hammering action which is transmitted to the drill bits 16.

As shown in FIG. 3 the reverse cluster drill 1 is attached to a drill string 20 which is inserted in a previously bored core drill hole 21 of approximately the same diameter as the drill string. The drill string 20 is in turn attached to a boring machine 26 of the type shown, for example, the boring machine supplied by NLC Company, Ltd. of Tokyo, Japan and distributed under the trade name Longyear Boring Machines. The boring machine 26 provides both rotation and tractive force to the drill string in operation to produce a bored hole 24.

To produce a horizontal bore hole, shafts 25 and 25a are dug at either end of the intended bore hole. A boring machine 26 is next deployed in one of the shafts (for example 25) and mounted on a foundation 27. The boring machine is utilized to produce a drilled hole generally by a core drill in the 4 to 6 in. range between shafts 25 and 25A in a conventional manner utilizing drill string segments to advance the core drill.

On completion of the cored hole the core drill is removed and replaced with the cluster drill according to the present invention. The drill string is then withdrawn and rotated carrying with it the cluster drill 1 and an attached auger 30 which would be inserted in sections 30 following the cluster drill by means of a service crane 32 or the like.

Pressure fluid is supplied to the cluster drill 1 by an air compressor 31 (for example) through the boring machine and drill string to produce rock cutting impact action on the rock drill bits 16. As the drill is drawn through the hole it enlarges it to the desired diameter, D2. The drill string in the smaller diameter D1 acts to centralize and stabilize the core drill as it is drawn into the larger diameter hole which it is producing. The drill string being in tension and acting as a centralizing stabilizer creates a straight true hole with the cluster drill.

Pressure fluid exiting the cluster drill 1 and the action of the rotating auger 30 trailing the cluster drill and attached thereto by the threads of socket flange 15, cleans the debris produced out of the large diameter hole and deposits it into shaft 25A where it may be removed. Once the cluster drill reaches the shaft 25 it is removed and the segments of the auger are likewise removed completing the job. Use of the auger greatly reduces the amount of air required for hole cleaning. However, air alone may be utilized to clean the hole.

The drilling system according to the present method has been utilized in boring holes of 500 to 800 millimeters (20 to 32 inches in diameter) in hard rock with hole lengths of 78 meters (230 ft.) with boring speeds substantially in excess of existing drilling methods. Longer and larger holes are well within the capability of this drilling system.

Having described my invention in terms of a preferred embodiment, it is recognized that variations may be made therein without departing from the invention as set forth in the claims.

I claim:

1. A gang drill for increasing the diameter of bored holes in hard rock comprising:

a plurality of individual percussion producing rock drills in a cylindrical drill body, said body having a rearward end and a forward end, said forward end having bit ends of said drills exposed for rock cutting arranged peripherally around said body and a drill string connected at the centerline of said drills to said body at its forward end for rotating and drawing said drills through a previously drilled bore hole to enlarge said previously drilled hole;

said body totally encloses said drills, said body being further provided with alignment means, securing means, and means for supplying pressure fluid for each of said drills, said pressure fluid entering said drills internally of said body and exiting said drills externally to said body at its forward end, whereby said body forms a peripheral passage for exiting of rock cuttings and provides protection for individual drills; and said means for supplying pressure fluid from said forward end of said body comprises a center core rod of approximately the same dimensions as an individual percussive drill allowing substitution for same and thereby providing for reversal of the direction of drilling of said gang drill.

2. A gang drill according to claim 1 wherein said core rod is provided with a central passage formal therein for receiving pressure fluid from said forward end of said body.

3. A gang drill according to claim 1 wherein: said center core rod replaces the center drill and said core rod is provided with a thread at its forward end for attachment to a drill string and is connected to the rearward end of said body by attachment means.

4. A gang drill according to claim 1 wherein: said gang drill has attached at its rearward end an auger means for assisting in the clearing of drilled debris, said auger means being rotated with said drill body.

5. A gang drill according to claim 4, wherein: said auger means is attached to said rearward end of said body by a socket flange adapted to be attached to an end plate in said body, said attachment means further serving as a sealing end cap for said end plate.

6. A gang drill for increasing the diameter of bored holes in hard rock comprising:

a plurality of individual percussion producing rock drills totally enclosed in a cylindrical drill body, said body having a rearward end and a forward end, said forward end having bit ends of said drills exposed for rock cutting arranged peripherally around said body and a drill string connected at the centerline of said drills to said body at its forward end for rotating and drawing said drills through a previously drilled bore hole to enlarge said previously drilled hole;

said body being further provided with alignment means, securing means, and means for supplying pressure fluid for each of said drills, said pressure fluid entering said drills internally of said body and exiting said drills externally to said body at its forward end, whereby said body forms a peripheral passage for exiting of rock cuttings and provides protection for said individual drills;

said means for supplying pressure fluid from said forward end of said body comprises a center core rod of approximately the same dimensions as an individual percussive drill allowing substitution for same and thereby providing for reversal of the direction of drilling of said gang drill;

said core rod is provided with a thread at its forward end for attachment to the drill string and is connected to the rearward end of said body by attachment means; and said core rod is provided with a central passage formed therein for receiving pressure fluid from said forward end of said body.

7. A gang drill according to claim 6, wherein said gang drill has attached at its rearward end an auger means for assisting in the clearing of drilled debris, said auger means being rotated with said drill body.

8. A gang drill according to claim 7, wherein, said auger means is attached to said rearward end of said body by a socket flange adapted to be attached to an end plate in said body, said attachment means further serving as a sealing end cap for said end plate.

9. A gang drill for increasing the diameter of bored holes in hard rock comprising:

a plurality of individual percussion producing rock drills totally enclosed in a cylindrical drill body, said body having a rearward end and a forward end, said forward end having bit ends of said drills exposed for rock cutting arranged peripherally around said body and a drill string connected at the centerline of said drills to said body at its forwardend for rotating and drawing said drills through a previously drilled bore hole to enlarge said previously drilled hole;

said body being further provided with alignment means, securing means, and means for supplying pressure fluid for each of said drills, said pressure fluid entering said drills internally of said body and exiting said drills externally to said body at its forward end, whereby said body forms a peripheral passage for exiting of rock cuttings and provides protection for said individual drills;

said means for supplying pressure fluid from said forward end of said body comprises a center core rod of approximately the same dimensions as an individual percussive drill allowing substitution for same and thereby providing for reversal of the direction of drilling of said gang drill;

said core is provided with a thread at its forward end for attachment to the drill string and is connected to the rearward end of said body by attachment means; and said gang drill has attached at its rearward end an auger means for assisting in the clearing of drilled debris, said auger means being rotated with said drill body.

10. A gang drill according to claim 9 wherein said auger means is attached to said rearward end of said body by a socket flange adapted to be attached to an end plate in said body, said attachment means further serving as a sealing end cap for said end plate.

11. A gang drill according to claim 10, wherein said core rod is provided with a central passage formed therein for receiving pressure fluid from said forward end of said body.

* * * * *